US005330003A

United States Patent [19]

Bullick

[11] Patent Number: 5,330,003

[45] Date of Patent: Jul. 19, 1994

[54] GRAVEL PACKING SYSTEM WITH DIVERSION OF FLUID

[76] Inventor: Robert L. Bullick, 5101 Dover Pl., New Orleans, La. 70131

[21] Appl. No.: 994,944

[22] Filed: Dec. 22, 1992

[51] Int. Cl.[5] ..... E21B 43/04; E21B 43/08

[52] U.S. Cl. ..... 166/278; 166/51; 166/205

[58] Field of Search ..... 166/278, 51, 74, 157, 166/158, 205, 296, 227, 236

[56] References Cited

U.S. PATENT DOCUMENTS 1,305,914 6/1919 Mack ..... 166/158
2,401,035 5/1946 Akeyson et al. ..... 166/205
2,913,051 11/1959 Lister ..... 166/296 X
3,216,497 11/1965 Howard et al. ..... 166/296 X
4,018,283 4/1977 Watkins ..... 166/296 X

*Primary Examiner*—William P. Neuder
*Attorney, Agent, or Firm*—Pravel, Hewitt, Kimball & Krieger

[57] ABSTRACT

Method and apparatus for gravel packing wells are provided. The area available for flow of fluid through a screen device is increased as increasing amounts of gravel are pumped into the well. External or internal means for increasing flow area are provided. Gravel pack screen assemblies by which flow area can be incrementally increased are disclosed.

30 Claims, 6 Drawing Sheets

GRAVEL PACKING SYSTEM WITH DIVERSION OF FLUID

BACKGROUND OF THE INVENTION

1. Field of the Invention

This invention pertains to method and apparatus for completion of wells by gravel packing. More specifically, improved gravel placement outside the gravel-packing screen is provided.

2. Description of Related Art

Mechanical exclusion is the most common method of preventing sand or other particles from entering a well as fluids are produced from or injected into the well. Various devices, called screens or slotted liners, having openings small enough to exclude particles when fluid flows into the well through the devices have been used. The placement of particles larger than formation particles between the screen or slotted liner and the formation is called gravel packing. The "gravel" size, normally from about 0.01 inch to several times this size, is selected to prevent movement of grains of formation material through the gravel pack. The size of openings in the screen is selected to prevent movement of gravel through the screen. The gravel is placed by pumping a slurry into the well after the screen is in place.

Gravel packing of wells began in the water well industry; it has been widely adopted in the petroleum industry. The pack may be placed in open hole or inside perforated casing. There are advantages and disadvantages of each type completion, but the cased-hole gravel pack is more common in oil and gas wells.

Placement of the gravel to form an effective filter in the well that has highest conductivity for fluids but prevents solid entry is a critical step in the gravel-packing operation. It is also important that no voids exist in the gravel pack, because formation solids may then flow through the screen and cause "sand-up" of the well. It is especially important in cased-hole gravel packs that gravel be placed between the perforations and the screen. Lack of gravel to protect the screen from the high velocity fluids entering through perforations can lead to early failure of the gravel pack from erosion of the screen opposite a perforation.

The fluid used to form the gravel slurry to be pumped into the well may be water-based, oil-based, an emulsion or a foam. Polymers may be used to increase the viscosity of the water or oil. If viscous fluid is used, the gravel is pumped at high concentration (in the range of 10 pounds per gallon) in the slurry, in a process called slurry packing. If low viscosity fluid is used, gravel concentrations in the range of 1 pound per gallon of the gravel are normally pumped and the fluid is circulated into and out of the well, the gravel particles being filtered out and formed into a pack as fluid passes through the screen in the well. Fluid may also flow out the perforations during the packing process.

Different techniques are available for flowing the gravel into a well. In the reverse circulation technique, the slurry is pumped down the annulus outside tubing in the well, gravel is filtered out on the screen, and return fluid flows back to surface through the tubing. More commonly, the "cross-over" method is used, in which the slurry is pumped down the well inside tubing, under conditions of higher flow velocity to prevent bridging of the particles, until the slurry is near the screen. A "cross-over" tool then directs flow from inside the tubing to the annulus outside the screen. Also connected to the cross-over tool is the "wash pipe," which is a pipe inside the screen which transports the fluid with gravel removed. The return fluid then flows up the annulus outside the tubing. The cross-over tool may be mounted inside a packer which seals the annulus outside the tool, called a "cross-over packer."

In vertical wells, gravel-packing success is greater than 90%. However, many wells are drilled which are deviated from vertical—offshore from platforms and in the arctic from pads, for example. Angles of deviation where the wellbores intersect hydrocarbon reservoirs are often above 45 degrees, and may be as high as 90 degrees. In addition to the deviated wells, more recently there has been rapid growth in the number of horizontal wells, in which holes are drilled at near 90 degrees angle for substantial distances in hydrocarbon reservoirs. Horizontal wells and deviated wells are also drilled for remediation of contamination of ground water and for other environmental applications. The success of gravel packing in these deviated and horizontal wells has been significantly less than in vertical wells. The lower success is generally ascribed to the difficulty of obtaining uniform and complete gravel placement in the annulus outside the screen. Gravel tends to form mounds or dunes outside the screen during placement. Settling of incompletely packed gravel around the screen also leaves parts of the annulus void of gravel. The state-of-the-art of gravel packing in general, and gravel packing in deviated wells in particular, is reviewed in the recent monograph *Sand Control,* Society of Petroleum Engineers, Richardson, Tex., 1992. As pointed out in Chap. 8 of this reference, at angles above about 60 degrees, transport and settling of gravel around screens requires special considerations.

One of the proposed solutions to the problem of gravel packing of highly deviated wells was to place cups on the wash pipe. The cups were proposed to decrease the tendency for sand to form dunes outside the screen. However, even with the cups, fluid can still enter or leave the annulus between the cups on the wash pipe. U.S. Pat. No. 4,046,198 discloses use of wash pipe (or "stinger") of increased diameter so as to increase flow resistance in the annulus between the wash pipe and the screen and minimize formation of dunes outside the screen. While this latter technique can increase placement efficiency of gravel, as shown in the monograph Sand Control on page 49, at high well deviation angles placement efficiency is still below 100 per cent. This failure to pack the annulus outside the screen with gravel can lead to gravel settling to the bottom of the annulus and gravel pack failure in deviated wells.

U.S. Pat. No. 5,165,476 proposes method and apparatus for increasing the efficiency of gravel placement in wells by restricting flow into the upper part of the screen during circulation of gravel slurry into the well. The restriction is then removed after gravel has been placed. The area of screen open for flow during gravel placement is fixed.

There is a long-felt need for method and apparatus to increase the efficiency of gravel placement outside screens devices in wells, particularly in wells where the screen device is at a high angle from vertical. The method should allow formation of a uniform gravel pack around the screen, the gravel filling the annulus outside the screen over the entire length of the screen.

SUMMARY OF THE INVENTION

A method of gravel packing a well is disclosed in which a screen is placed in the well and anchored to the wall of the wellbore, mechanical means are used to direct fluid flow through the distal end of the screen, and the area of screen open to flow is increased from the distal end as slurry is pumped down the well and outside the screen. In one embodiment, a solid sleeve concentrically placed over the screen is removably fixed to the screen so as to cover the screen, the sleeve is freed to move axially after the screen is anchored to the wall of the wellbore and the sleeve is axially moved to expose increasing area of the screen as slurry is pumped down the well and outside the screen. The sleeve is left in the wellbore above the screen. In yet another embodiment, the sleeve is axially moved to expose increasing area of the screen and the sleeve is then removed from the well.

In another embodiment, the screen is initially plugged by removable or shearable plugs, fluid flow is directed to the distal end of the screen and the area of flow through the screen is increased by movement of a plug remover or cutter through the interior of the screen as slurry is pumped down the well and outside the screen. The plug remover is attached to the wash pipe normally used during gravel-packing operations.

In another embodiment, a screen having areas plugged to flow in the axial direction, these areas being equally spaced along the axis of the screen, is provided and cups on wash pipe having the same axial spacing are provided. The wash pipe is moved up in increments equal to the spacing of the areas on the screen and the cups on the wash pipe as slurry is pumped down the well and outside the screen.

Apparatus for gravel packing a well is provided, comprising a screen having a concentric sleeve outside the screen covering at least a part of the screen, the sleeve being slidable along the common axis of the screen and sleeve so as to expose increasing area of the screen. In another embodiment, a screen plugged by removable means of plugging inside the screen is provided. Holes in the base pipe of a screen are plugged with shearable plugs. A means for shearing plugs when pulled through the screen is provided, such means being attached to a wash pipe used in gravel packing.

DESCRIPTION OF PREFERRED EMBODIMENTS

Figure 1:
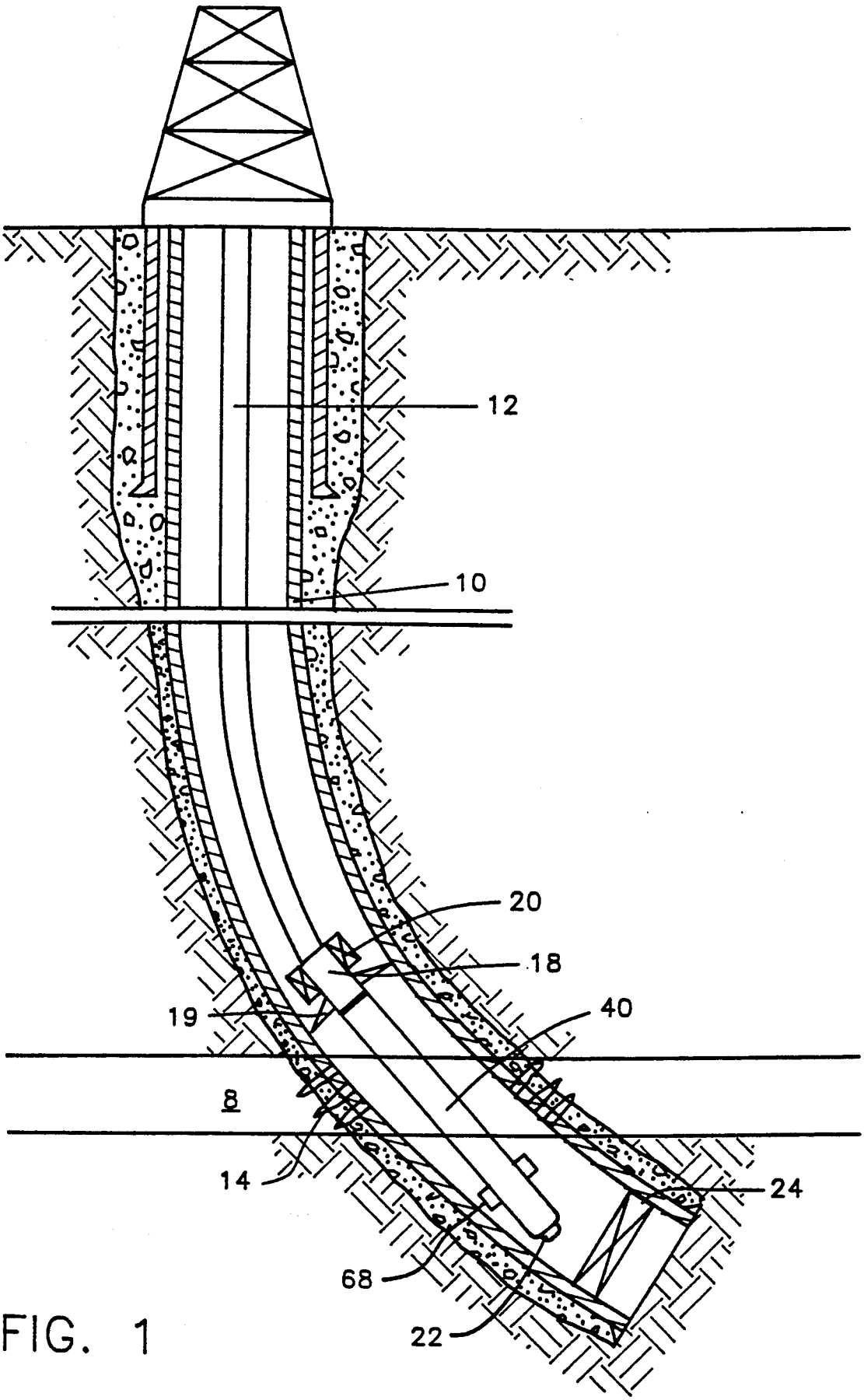
FIG. 1 is a schematic drawing of placement of apparatus in a deviated well.

Referring to FIG. 1, casing 10 has been placed in a deviated well drilled through formation 8. All casings in the well have been cemented using normal procedures. Casing 10 has perforations 14 which preferably have been prepacked with gravel, using well-known procedures. Anchor packer 24 has been placed in the well and set by electric wire line, work string or by coiled tubing. Screen assembly 40 has been run into the well on work string 12. At the bottom of work string 12 is packer 20, which has not been set. Packer 20 is attached to screen assembly 40. Swab cup 19 points downward so as to contain pressure from below. Centralizer 68 separates assembly 40 from the wall of the casing. At the bottom of screen assembly 40 is latch ring 22. As the assembly is lowered into the well, latch ring 22 contacts anchor packer 24 and locks the screen (not shown) in screen assembly 40 to anchor packer 24.

Figure 2A:
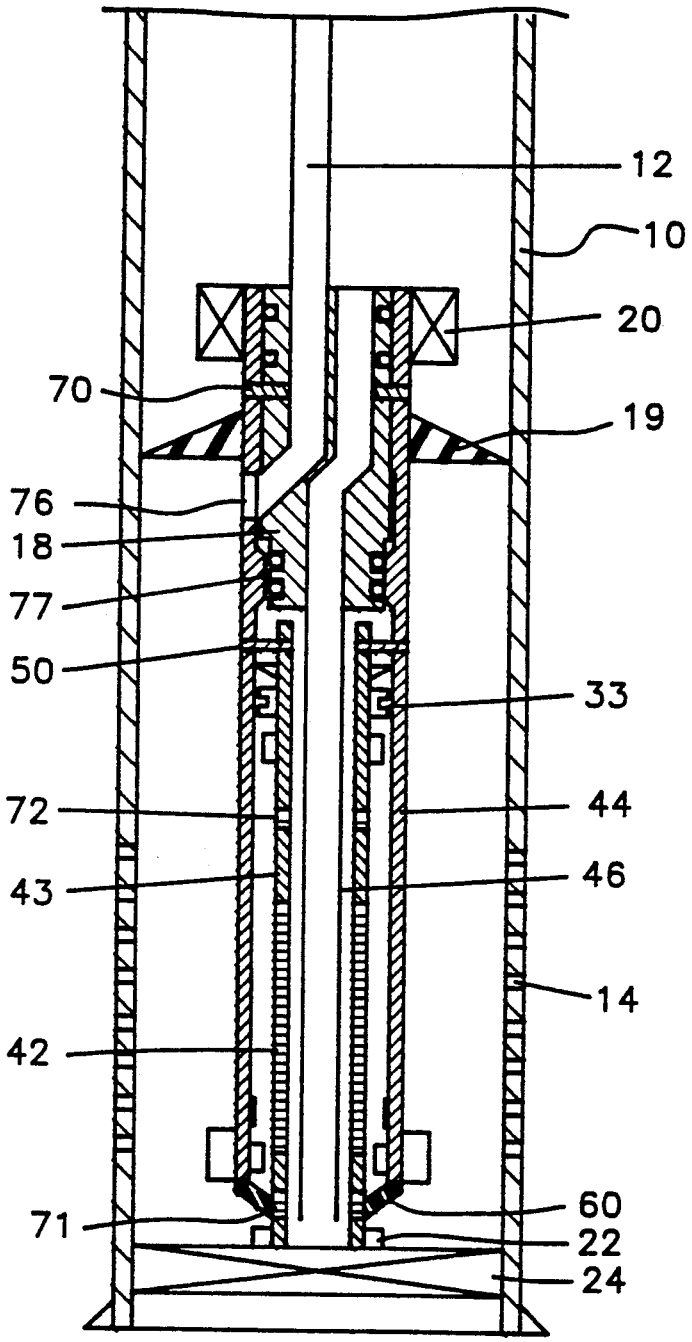
FIG. 2(*a*), (*b*) and (*c*) are schematic drawings of apparatus for increasing open screen area by moving an enclosing sleeve and leaving the sleeve in the well.
Figure 2B:
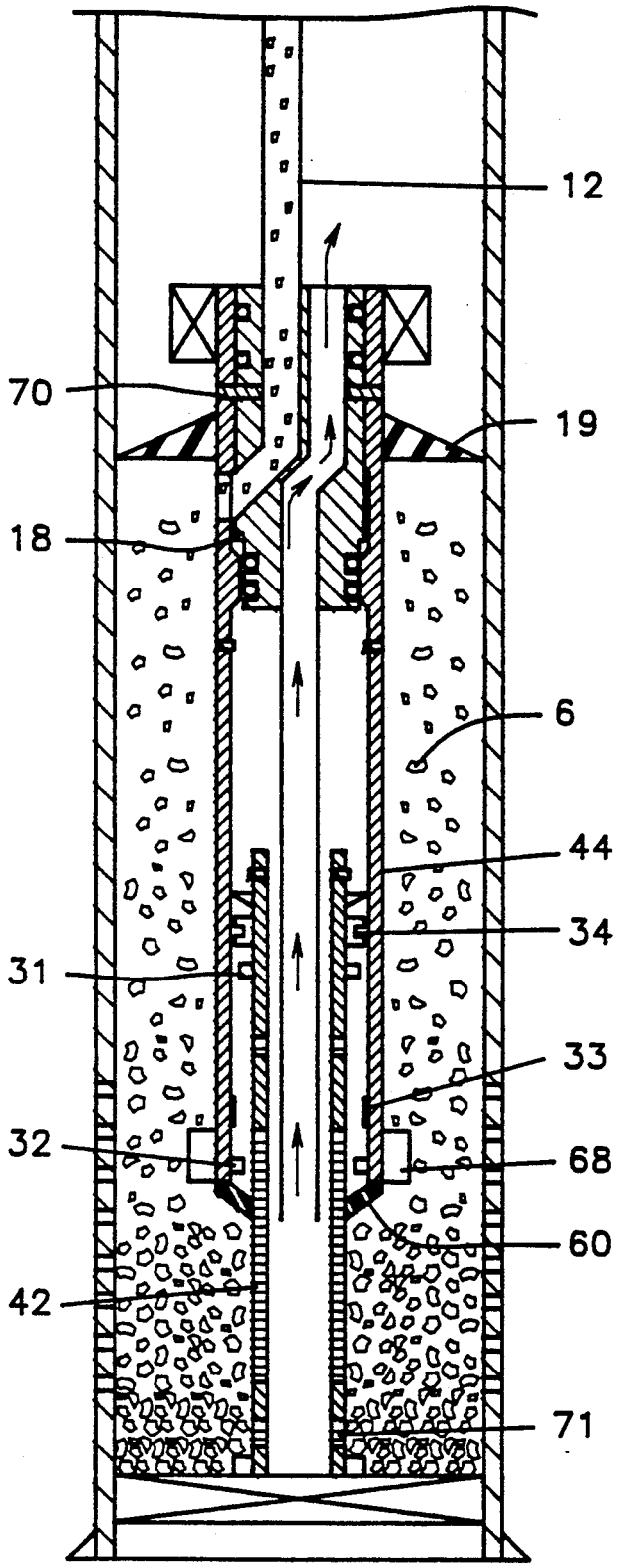
Figure 2C:
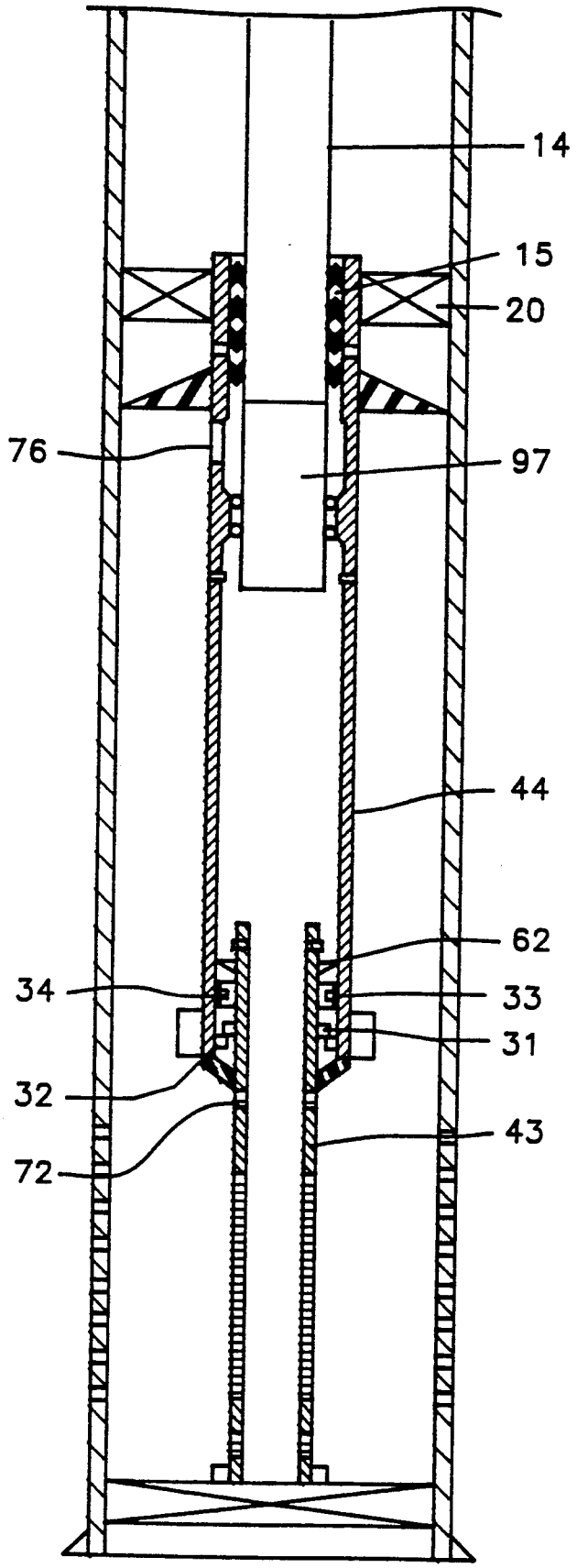

FIGS. 2(*a*), 2(*b*) and 2(*c*) show details of the installation of a preferred embodiment of screen assembly 40. Although the assembly is shown in a vertical direction, it should be understood that it can be placed in a well at any angle, including horizontal. FIG. 2(*a*) illustrates the assembly after it has been locked to the anchor packer, FIG. 2(*b*) shows the assembly as it is being operated to gravel pack the well, and FIG. 2(*c*) depicts the assembly after the sleeve has been fully moved to expose all screen area, the sleeve remains in the well, the cross-over tool and wash pipe have been removed and production tubing has been installed.

Referring to FIG. 2(*a*), work string 12 is joined to packer 20. Inside packer 20 is crossover tool 18. Joined to packer 20 below the packer is a sub having a swab cup 19 attached thereto, the swab cup being positioned so as to confine pressure below. Joined to the swab cup sub is a ported sub having ports 76. Joined to the ported sub is a sub having seals 77. Joined to the seal sub is a pin sub having pin 50. Sleeve 44 is joined to the sub having pin 50. As screen assembly 40 is placed in the well, swab cups 19 cause wellbore fluid to flow through the assembly. Lock ring 22 has locked screen 42 and parts coupled to it to anchor packer 24. Screen 42 is removably fixed to sleeve 44 by shear pin 50. The coupled wash pipe 46 and cross-over 18 are fixed to sleeve 44 by higher strength shear pin 70. Seal 60 at the end of sleeve 44 preferably does not completely cover lower tell-tale screen 71 before pin 50 is sheared, such that circulation of fluid through that screen is possible. Movement of sleeve 44 to expose increasing area of screen 42 is initiated by a pull through work string 12 to shear pin 50.

Referring to FIG. 2(*b*), gravel particles 6 are being pumped down work string 12 and through crossover tool 18 into the annulus outside sleeve 44 and below swab cup 19. A partial gravel pack formed near the distal end of the screen is covering tell tale screen 71 and part of screen 42. Seal 60 on sleeve 44 slides over screen 42 as sleeve 44 is moved to expose greater area of the screen. Seal 60 may be of construction similar to a swab cup or may be a deformable material in a variety of shapes designed to slide along in contact with screen 42. Seal 60 is designed to prevent gravel entering between sleeve 44 and screen 42.

Centralizer 68 is used to ensure a more uniform distribution of gravel around the screen. Centralizer 68 may also be of a design to direct flow toward perforations and the top of the screen in highly deviated or horizontal wells. Such centralizer-flow directors are known in the art. Centralizer 68 may also be of conventional solid or special solid centralizer construction. Sleeve 44 may also have secondary seals (not shown) to back-up the seal 60 as it slides over uneven diameters of the screen. Primary and secondary seals located on sleeve 44 are preferably spaced so that at all times during the gravel-packing operation a seal is in contact with the blank pipe or screen within the sleeve. Inside sleeve 44 also is stop 30. Stop 30 will prevent further movement of sleeve 44 when the stop tags on stop seat 31.

Referring to FIG. 2(*c*), showing the sleeve at the end its movement, polish bore 33 is in place over polish bore seals 34. Seal 62 is present to prevent gravel or other debris from falling between the screen and sleeve during gravel packing operations. Sleeve 44 serves as a blank pipe above the screen. The equipment shown at the top of sleeve 44 will be explained below.

To run screen assembly 40 in a well, the preferred procedure is as follows. Pick up sleeve 44 having flexible end seal 60 and centralizer 68. Next, slip the pin end of the joint having lower tell tale screen 71 through the sleeve. The tell tale screen is preferably at least two feet in length. Next, screw the tell tale joint into the mechanical or hydraulic anchoring packer 24 if the packer 24 is to be run with the screen assembly. Alternatively, packer 24 can be run into the well and set by electric wire line or work string prior to running the screen assembly 40 into the well. This latter procedure is shown in FIG. 1. When this alternative is followed, snap latch 22 is run such that the pin end of the tell tale joint can snap into the latching area on the packer. In open hole completions, an inflatable packer is preferably used as anchor packer 24.

The next step is to pick up the sleeve section containing stop 30 and polished bore 33 and slip this section over the joint having tell tale screen 71. This section is screwed into the previously mentioned joint of sleeve 44. Then a joint of screen is followed by a joint of sleeve until the designed amount has been assembled. Normally, at least one joint of blank pipe 43 is placed above the screen. The last screen joint to be picked up contains upper tell tale screen 72. This is followed by picking up and assembling the top joint of the sleeve. On top of the joint having tell tale screen 72 a sub is placed which has several O-ring or polypack grooves 34 cut in the outside of the sub. These O-rings or polypacks will seal the inside of polished bore 33 when it is pulled upward over the O-rings, as shown in FIG. 2(*c*). This will provide a pressure seal between the sliding sections and the stationary sections if the sleeve assembly is to be left in the well.

A second sub is screwed into the sub containing the seals. This sub has a shear pin groove cut into the outside diameter to accept selected shear pins. Although shear pins are referred to herein, hydraulic or other mechanical releasing devices could be used in place of shear pins, as is well known in the art.

The sub containing shear pin 50 is screwed into the last joint of sleeve 44. When pin 50 is inserted, sleeve 44 and screen 42 are removably fixed to prevent their relative longitudinal or axial movement until pin 50 is sheared.

Internal wash pipe 46 is assembled. The pipe preferably contains a centralizer (not shown) near the end of the wash pipe. Wash pipe 46 is placed inside the screen until the end of the wash pipe is a few feet below seal 60. The top of the wash pipe is then connected to the bottom of the inner threads of crossover tool 18. The swab cup 19 prevents gravel pack sand from going upward during pumping. Sealed movement of the cross-over production packer 18 and sleeve 44 as the sleeve is retracted while gravel is being pumped into the well is then possible. After the wash pipe is installed, the pin end of production packer 20 is attached to the sub which contains swab cup 19. This sub is a part of sleeve 44. Pin 70 is installed. Pin 70 is designed to release at a greater tensile pull than pin 50, and allows the crossover tool and wash pipe to be removed from packer 20 after it is set. Again, this release could also be achieved by hydraulic or other mechanical means known in the art.

Work string 12 may be conventional tubing or coiled tubing. Preferably, a TIW valve is run in a conventional work string. The valve will be closed when laying down joints or stands of work string as screen assembly 40 is moved in the well. It will be necessary to lay down joints if the interval to be gravel packed is longer than a stand that the rig is capable of pulling.

Screen assembly 40 (FIG. 1) is placed in the well at the desired depth. If anchoring packer 24 is attached to assembly 40 as it is placed in the well, the packer is then set. If the packer has already been set in the well, assembly 40 is latched into the anchoring packer with latch 22.

After the screen is anchored, tension is applied through work string 12 to shear the pin 50. After the pin is sheared, sleeve 44, production packer 20 with crossover 18, swab cup 19, wash pipe 46 and work string 12 are free to move. The remainder of the equipment is fixed in the well by anchor packer 24. Circulation through the well is begun. The movable equipment may be moved upward to the point that seal 60 is clear of lower tell tale screen 71 before circulation begins. Fluid crosses over to the annulus, flows through the area of the screen that is open and upward through wash pipe 46 to the crossover tool, then through the annulus to surface.

At the surface, conventional gravel packing equipment is used (not shown). Gravel is mixed, preferably at concentrations between about 1 and 2.5 pounds per gallon, and pumped at a rate of about 2.5 to 3.5 barrels per minute. When pump pressure begins to increase, indicating that the annulus surrounding screen area exposed to the gravel slurry is packed, the movable apparatus is moved upward, preferably a few feet, while continuing to pump gravel slurry.

The amount of gravel added to the fluid is preferably calculated and compared with the volume of annulus to be filled up to various locations on the screen. Each time pump pressure increases after a known amount of gravel has been pumped, the sleeve is pulled up an additional distance. Alternatively, sleeve 44 can be moved continuously while slurry is being pumped. Pump pressure is monitored closely and, preferably, measured gravel volumes pumped are compared with the distance that would be packed in the annulus and to the distance that sleeve 44 has been moved longitudinally or axially along the screen.

Work string 12 joints are laid down at the surface as each joint or stand pulls above the rotary until the annulus around the screen is completely packed. When the annulus is packed, there will be a sharp increase in pump pressure. A TIW valve is preferably installed in the open position in the work string at every point where a joint or stand will be laid down. Sufficient joints or stands of work string are pulled and laid down until the end of sleeve 44 is above the upper tell tale screen 72. Stop 31 is contacted by stop 30, indicating that the seal 34 and polish bore 33 are properly located for sealing. Preferably, sufficient tension is then applied to the work string to leave the screen at the neutral weight point. Enough gravel is then circulated to cover blank pipe 43 and upper tell tale screen 72. Packer 20 is then set.

After the packer is set, crossover tool 18 is released from packer 20 by shearing of pin 70. Alternatively, the release is accomplished by hydraulic methods widely known in industry. Crossover tool 18 with wash pipe 46 attached are removed from the well. Packer 20 now contains a polished bore area. Referring now to FIG. 2(*c*), after the work string and attached equipment are removed from the well, tubing 14 having seal assembly 15 attached is placed in the well and sealed in the packer. Stinger 97, designed to seal opening 76 in sleeve 44, is run on the tubing and placed below the seal assembly in the packer.

In FIG. 2(*c*), sleeve 44 remains in the well as blank pipe after the gravel packing operation. In an alternative embodiment, the sleeve is pulled from the well along with the crossover and wash pipe. In this embodiment, pin 70 and parts 31, 32, 33 and 34 are not required. Crossover tool 18 without a production packer is attached to screen 42 or the sub at the top end of screen 42 containing pin 50. Sleeve 44, wash pipe 46 and crossover tool 18 are all withdrawn from the well after gravel packing, leaving a polish bore at the top of screen 42 where the crossover tool 18 is withdrawn. Production tubing having a packer attached and a stinger which will seal in the polished bore is then run into the well using conventional techniques.

In another embodiment, a crossover tool is not used and the gravel is pumped down the annulus outside work string 12. Movement of the sleeve and other procedures remain the same as described above.

Figure 3:
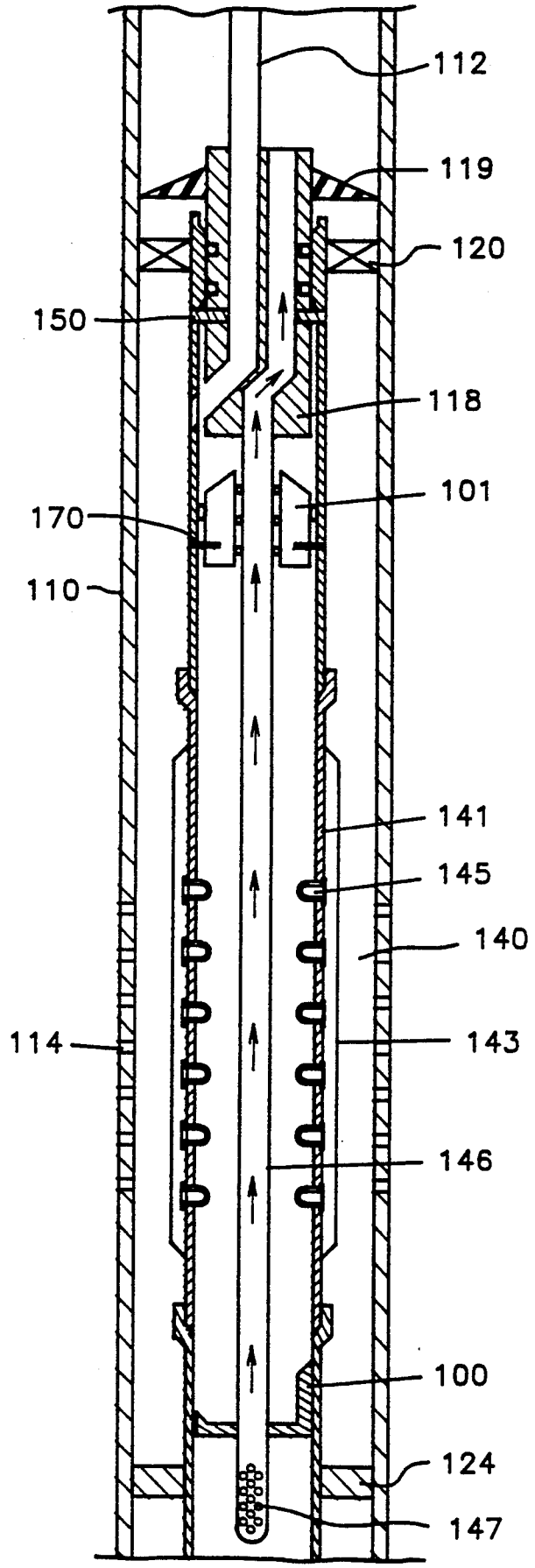
FIG. 3 is a schematic drawing of apparatus for increasing open area by shearing plugs from holes in the base pipe of a screen.

An alternate method and apparatus for directing flow through an increasing area of the screen is shown in FIG. 3. Screen assembly 140 has been placed in a well having casing 110 and perforations 114 therein. Plugs 145 are provided in base pipe 141 of the screen assembly. Base pipe 141 is covered by wire wrapping 143, as in conventional welded screens. Plugs 145 are removed to allow flow area to incrementally increase as wash pipe 146 is retracted or moved upward through base pipe 141. Means for removing the plugs 100 is attached to wash pipe 146. Sump packer 124 is optional.

Plugs 145 may be placed in base pipe 141 before screen 143 is wrapped on the base pipe. Alternatively, the plugs may be inserted by press fit or any suitable fastening means after the screen has been wrapped. Plugs 145 preferably are hollow, such that when the end of the plug protruding inside base pipe 141 is removed, the hole through the plug allows flow through the base pipe and then through the screen above the base pipe.

Plugs 145 are designed to be removed by plug cutter 100. Plug cutter 100 may have a diameter just slightly less than the inside diameter of base pipe 141, but should have dimensions such that it moves easily through the base pipe. Plugs 145 are preferably made of soft material such as aluminum or magnesium or alloys thereof, such that plug cutter 100 will easily shear the plugs. Plugs 145 may be scored such that shearing in a desired direction is facilitated. Preferably, wash pipe 146 is not open at bottom, but contains perforated section 147 near the end. The perforations should be small enough to prevent flow of sheared plug segments into the wash pipe.

To eliminate flow between screen wrapping 143 and base pipe 141, a solid material may be placed therein which will later dissolve. Such material may be placed in rings spaced longitudinally along the screen (not shown). Such material will decrease flow which would otherwise occur through the screen wrapping and along the base pipe to an opening in the base pipe.

Plug cutter 100 is shown in FIG. 3 as having a cutting arm which extends farther on one side of base pipe 141. Such cutter may be used to open a selected side of the screen to flow before other areas of the screen are opened. This feature can be useful in deviated or horizontal wells, where the upward side of the screen may be opened first to flow. This will cause gravel to flow to the upward side of the annulus selectively and will cause higher efficiency packing of the annulus with gravel. It will be necessary to orient plug cutter 100 as it is placed in the well, using conventional methods of maintaining pipe in a known direction, or by surveying after the pipe is run to determine the direction of plug cutter 100, using methods of measuring azimuth angle which are well-known in the art.

Other methods may be used for incrementally opening screen assembly 140 for flow by moving wash pipe 146. Base pipe 141 may have a plastic or other film coating which is mechanically ruptured or removed by movement of wash pipe 146 having arms or other cutting device attached thereto. Angular movement of such arms may be caused by a motor (not shown) driven by flow through wash pipe 146.

Using the apparatus of FIG. 3, gravel packing operations are carried out by setting packer 120. Swab cup 119 is above the packer to contain pressure below the swab cup and prevent flow of gravel above the swab cup. Tension pulled on work string 112 causes shear pin 150 to fail. Crossover 118 and wash pipe 146, with plug cutter 100 attached, are then pulled up a few feet to cut plugs to a selected depth and open the screen for circulation. Pumping of slurry begins and work string 146 is pulled up to expose increasing areas of screen to flow.

When gravel packing is complete, extra tension on work string 112 and resulting force of cutter 100 against pack-off 101 causes shear pin 170 to fail, which allows wash pipe 146, crossover 118, swab cup 119 and pack-off 101 to be withdrawn from the well. A polish bore is then left inside packer 120 for placement and sealing of production tubing in the well.

Although use of the outside sleeve has been described in FIG. 2 and the use of the inside plug cutter has been described in FIG. 3, it is clear that the configurations shown in FIGS. 2 and 3 can be combined and used simultaneously. The location of the plug cutter on the wash pipe may be selected to be either above or below the distal end of the sleeve.

Figure 4:
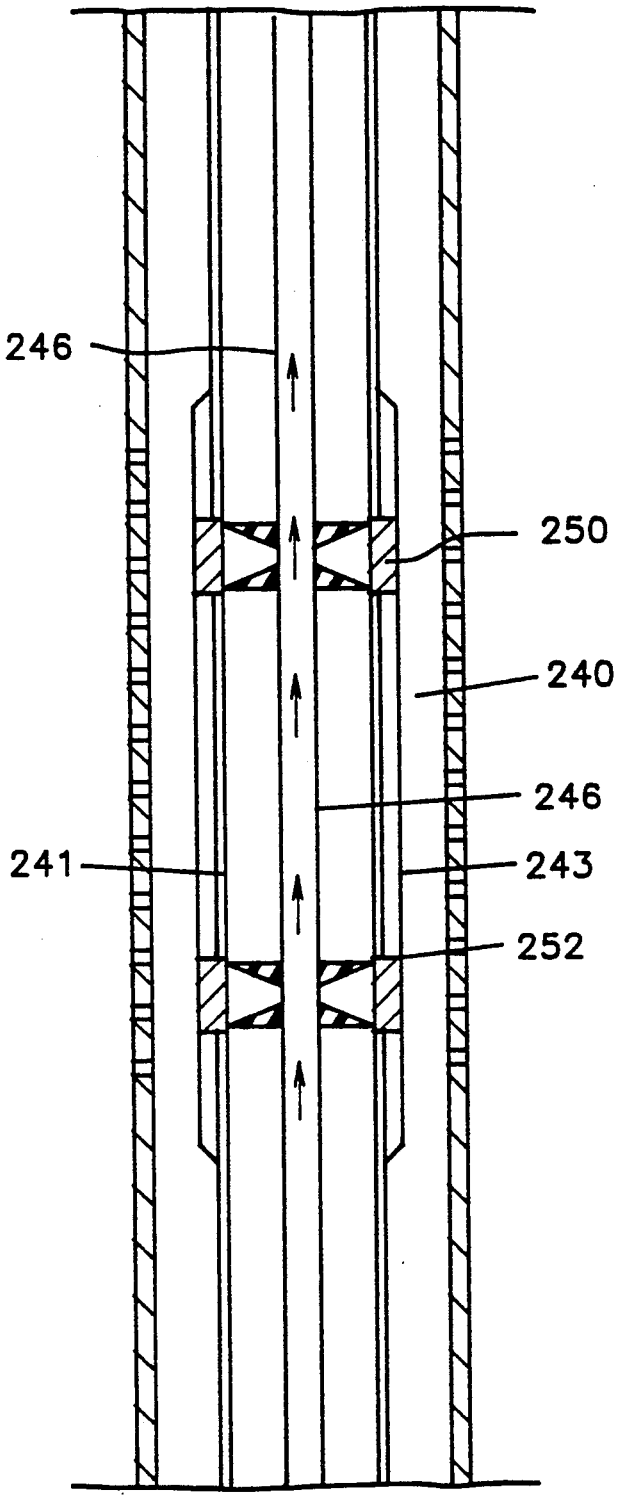
FIG. 4 is a schematic drawing of apparatus for increasing open screen area by moving in increments a wash pipe having cups thereon.

Another embodiment for increasing the area of screen through which flow occurs during gravel placement is shown in FIG. 4. In this embodiment, screen assembly 240 is made up of a wire-wrapped screen having wire 243 and base pipe 241, wash pipe 246 and cups 252. One of more cups may be used. Cups 252 may be pairs of cups directed in opposite directions so as to confine pressure from above or below, as shown in FIG. 4. The screen has segments 250 which block flow in the axial direction along the screen. Such screen may be a "Selective Isolation" screen, such as sold by Nagaoka International Corporation of Osaka, Japan, in which welds are placed along the screen to produce 5 feet sections of screen separated by 1 foot segments along which flow cannot occur in the axial direction.

To increase the area of screen available for flow-through during the gravel-packing operation, wash pipe 246 is moved upward during gravel packing. Cups 252 are preferably spaced-apart a distance equal to the distance between segments 250. The wash pipe is preferably moved in increments such that the cups 252 are within a segment 250 during most of the gravel placement time. The area of the screen below the lowest cup 252 is open for unrestricted flow. The area of the screen above the lowest cup 252 is available for little if any flow-through of the fluid carrying the gravel, because the axial flow inside the screen is blocked by cups 252 and segments 250. Preferably, segments 252 are not more than a few feet apart. They may be equally spaced apart or they may be spaced apart known distances. The equipment above the screen may be the same as that shown in FIG. 3

The fluid used for "bottom up" gravel packing as described herein may be any fluid used in conventional gravel packing. Polymers, emulsifiers, foaming agents or other chemicals may be added to increase viscosity of either water-base or oil-base fluids to a sufficient amount to assist in carrying the gravel into the well. The gravel used may be comprised of any gravel-packing material, including lightweight materials known in the art for packing deviated wells.

An advantage of the exterior sleeve diverting apparatus and method shown in FIG. 2 is that the screen will be completely covered and protected while it is being placed at the suitable location in the well. Plugging of the screen by debris in the well during this period is a problem in many gravel-pack operations. Also, the movement of the sleeve during gravel packing will facilitate the breaking up of any sand bridges that might form during the gravel-packing process. The gravel placement velocity will be greater with the exterior sleeve having a larger diameter than the gravel screen. The exterior sleeve can also be used as a washover pipe should the screen fail and removal be desirable.

Advantages of the apparatus and method illustrated in FIGS. 3 and 4 are that a sliding surface exterior to the screen will not be necessary; this will reduce the possibility of sticking, particularly in very long screen sections or in wells where hole instability may occur.

The advantage of all embodiments illustrated herein is the elimination of voids in the gravel pack. Selective packing from the distal end or most remote end of the screen, allowing full packing of the annulus in short segments, eliminates the sand dunes which are known to form around screen in highly deviated wells. Either apparatus to incrementally increase flow area of the screen open should reduce the amount of blank pipe needed, since this bottom-up packing process will reduce the need for large amounts of gravel reserve above the screen section. Gravel packs can better be performed in sections to accommodate very long or sharp turn wells. These procedures will not affect selection of screen size or type or gravel size.

It will be appreciated that while the present invention has been primarily described with regard to the foregoing embodiments, it should be understood that variations and modifications may be made in the embodiments described herein without departing from the broad inventive concept disclosed above or claimed hereafter.

What I claim is:

1. A method of gravel packing a selected interval of a well comprising:

placing a screen in the well and anchoring the screen to a location opposite the selected interval; and increasing the area of the screen open for flow therethrough during gravel-packing.

2. The method of claim 1 wherein the area of the screen open for flow is increased by axial movement of a concentric sleeve covering the screen.

3. The method of claim 1 wherein the area of the screen open for flow is increased by axial movement of a wash pipe inside the screen.

4. The method of claim 1 wherein the area of the screen open for flow is increased by simultaneous axial movement of a concentric sleeve covering the screen and a wash pipe inside the screen.

5. The method of claim 2 wherein the sleeve is moved to a selected location along the axis of the sleeve and the screen and a hydraulic seal is thereby formed between the sleeve and the screen by the movement to the selected location.

6. The method of claim 2 wherein the sleeve is removed from the screen and removed from the well.

7. The method of claim 1 wherein the screen is comprised of a base pipe and a wire wrapping thereon, the base pipe having openings with plugging means therein, and the area of the screen open for flow during gravel packing is increased by axial movement of a wash pipe inside the screen to remove the plugging means from the base pipe.

8. The method of claim 3 additionally comprising a plurality of axially spaced-apart segments of the screen blocked to flow along the axis of the screen and the wash pipe comprises a plurality of equally spaced-apart cups thereon, wherein the wash pipe inside the screen is moved during gravel-packing operations such as to move between segments of the screen blocked to flow along the screen.

9. The method of claim 1 wherein the area of the screen open for flow is increased while gravel is being pumped.

10. The method of claim 1 wherein pumping of gravel is interrupted while the area of the screen open for flow is increased.

11. The method of claim 1 wherein an amount of gravel pumped into the well is measured and compared with a calculated volume of annulus around the screen.

12. A method for gravel packing a selected interval of a well comprising:

placing a packer in the well below the interval where gravel is to be placed and setting the packer;

placing a screen in the well, the screen being at least partly covered by a sleeve, the sleeve being removably fixed to and slidable over the screen; and with the screen fixed to the packer, releasing the sleeve from the screen and pumping a slurry down the well, sliding the sleeve so as to expose increasing area of the screen for flow therethrough.

13. The method of claim 12 wherein the screen is fixed to the packer by locking means after the screen is placed in the well.

14. The method of claim 12 wherein the packer is fixed to the screen on the surface and the packer is set after the screen is placed in the well.

15. The method of claim 12 wherein the packer is an inflatable packer set in open hole.

16. The method of claim 12 further comprising moving the sleeve to a pre-set location and measuring pumping pressures to determine the location of the top of the gravel pack in the well.

17. A method for gravel packing a selected interval of a well comprising:

placing a screen assembly in the well, the screen assembly comprised of a screen, a packer connected to the screen, internal means for plugging flow through the screen and a wash pipe, the wash pipe having means attached thereto for removing the internal means for plugging;

positioning the screen opposite the selected interval and setting the packer; and pumping gravel down the well and moving the wash pipe to remove the internal plugging means from the screen.

18. The method of claim 17 wherein the internal means for plugging flow comprises metal plugs and the means for removing the plugs comprises a cylinder.

19. The method of claim 17 wherein the means for removing the internal plugging means is oriented in the well so as to open the screen first in a selected azimuth direction.

20. Apparatus for controlling particle movement into a well comprising: .

a screen device; and a sleeve having an end to move over the screen device, the sleeve being adapted to slidably move over the screen device so as to expose increasing area of the screen for flow through the screen below the end.

21. The apparatus of claim 20 further comprising means for decreasing flow between the end of the sleeve and the screen device.

22. The apparatus of claim 20 wherein the screen device is a slotted liner or wire-wrapped screen.

23. The apparatus of claim 20 further comprising means for removably fixing the sleeve to the screen device.

24. The apparatus of claim 20 wherein the sleeve comprises means for stopping movement at a selected location over the screen and means for hydraulically sealing the sleeve to the screen.

25. The apparatus of claim 20 further comprising a crossover tool removably fixed to the sleeve.

26. Apparatus for controlling particle movement into a well comprising:

a screen device, the screen device being plugged with internal means for plugging;

a wash pipe adapted to move inside the screen, the wash pipe having attached thereto means for removing the internal means for plugging of the screen device.

27. The apparatus of claim 26 wherein the screen device is a wire-wrapped screen having a base pipe, the base pipe having a plurality of longitudinally spaced-apart openings, and the internal means for plugging is a plurality of plugs in the openings.

28. The apparatus of claim 27 wherein the plugs are hollow cylinders having a plugged end, the cylinders protruding inward from the base pipe.

29. The apparatus of claim 26 wherein the means for removing the internal plugging of the screen device is a ring-shaped cutting edge.

30. Apparatus for controlling particle movement into a well comprising:

a screen device, the screen device being plugged to axial flow by a plurality of spaced-apart segments, the spacing of the segments being selected; and a wash pipe, the wash pipe having attached thereto at least one cup designed to prevent flow between the wash pipe and the screen.

* * * * *